US006283261B1

(12) United States Patent
Sher

(10) Patent No.: US 6,283,261 B1
(45) **Date of Patent: *Sep. 4, 2001**

(54) LUGGAGE FRAME

(76) Inventor: Yu-Yi Sher, 7F, B Lock B, No. 58, Sec. 1, Min Shenge Rd., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/503,158

(22) Filed: Feb. 14, 2000

Related U.S. Application Data

(63) Continuation-in-part of application No. 09/362,160, filed on Jul. 28, 1999, now Pat. No. 6,131,713.

(51) Int. Cl.[7] ..... A45C 5/14; A45C 13/32; A45C 13/36

(52) U.S. Cl. ..... 190/122; 190/24; 190/18 A; 190/127

(58) Field of Search ..... 190/122, 127, 190/24, 18 A

(56) References Cited

U.S. PATENT DOCUMENTS

| | | | | |
|---|---|---|---|---|
| 5,560,459 | * | 10/1996 | Lin | 190/127 X |
| 5,685,402 | * | 11/1997 | Lin | 190/127 X |
| 6,119,835 | * | 9/2000 | Lin | 190/122 X |
| 6,131,713 | * | 10/2000 | Sher | 190/122 |

* cited by examiner

*Primary Examiner*—Sue A. Weaver
(74) *Attorney, Agent, or Firm*—Harrison & Egbert

(57) ABSTRACT

A luggage frame including two upright support rods, two brackets fastened respectively to the top end of the upright support rods, two base seats fastened respectively to the bottom end of the upright support rods, two caster mounts fastened respectively to the base seats, a top plate fastened to the two brackets, and a bottom plate fastened to the caster mounts.

1 Claim, 9 Drawing Sheets

LUGGAGE FRAME

RELATED APPLICATIONS

The present application is a continuation-in-part of U.S. application Ser. No. 09/362,160, filed on Jul. 28, 1999, and entitled "IMPROVEMENT ON FRAMEWORK OF LUGGAGE", presently U.S. Pat. No. 6,131,713.

TECHNICAL FIELD

The present invention relates generally to luggage, and more particularly to a frame of the luggage.

BACKGROUND ART

The conventional luggage frame is generally defective in design in that it is heavy, and that it limits the available space for holding the articles.

SUMMARY OF THE INVENTION

It is the primary objective of the present invention to provide a luggage frame which is light in weight to reduce the overall weight of the luggage.

It is another objective of the present invention to provide a luggage frame which enables the luggage to have a relatively large space for holding the articles.

In keeping to the principle of the present invention, the foregoing objectives of the present invention are attained by a luggage frame comprising two upright support rods, two brackets fastened respectively with the top end of the upright support rods, two base seats fastened respectively to the bottom end of the upright support rods, two caster mounts fastened respectively to the base seats, a top plate held by the two brackets, and a bottom plate held by the caster mounts.

The foregoing objectives, features, functions, and advantages of the present invention will be more readily understood upon a thoughtful deliberation of the following detailed description of two preferred embodiments of the present invention with reference to the accompanying drawings.

DETAILED DESCRIPTION OF THE INVENTION

Figure 1:
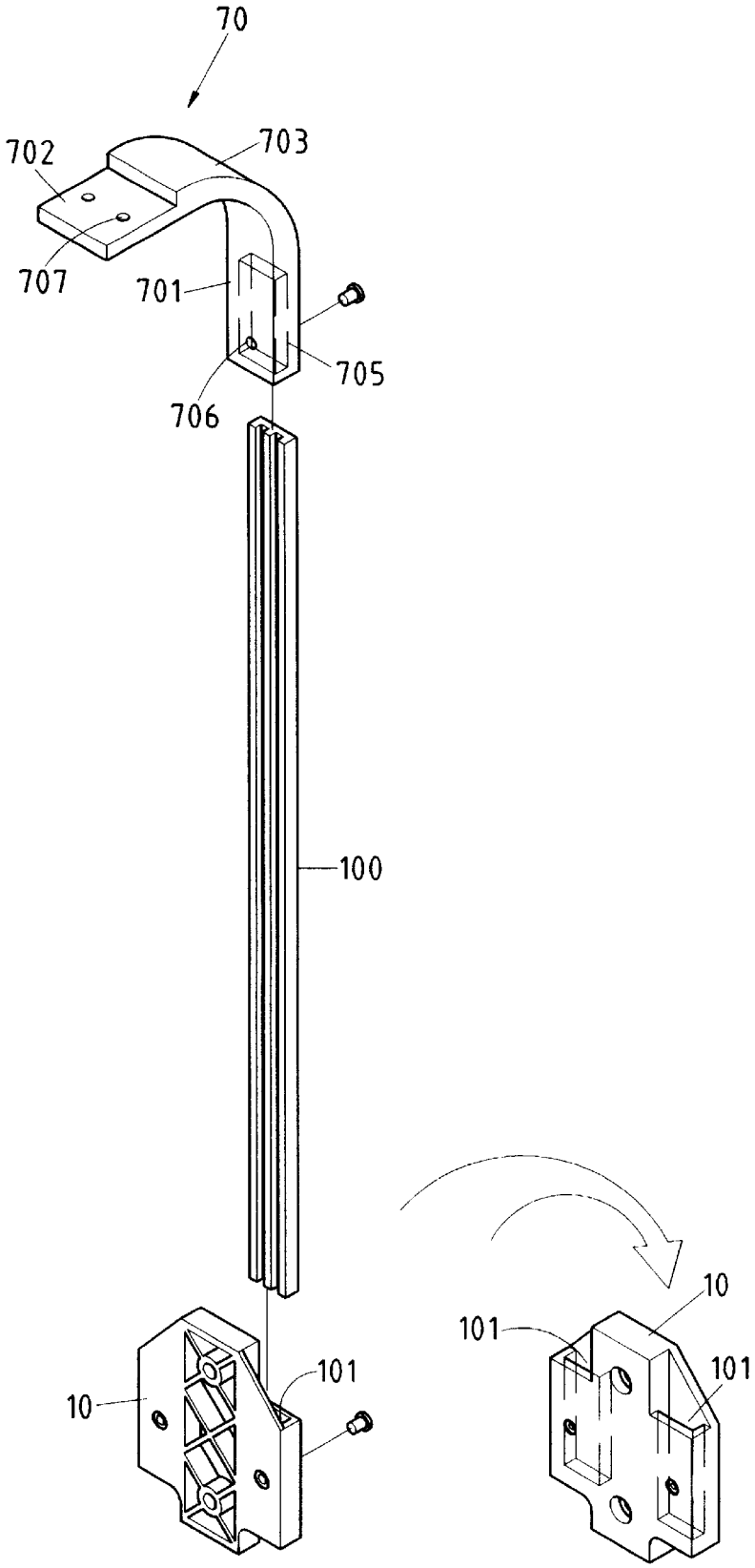
FIG. 1 shows a partial exploded view of a first preferred embodiment of the present invention.
Figure 2:
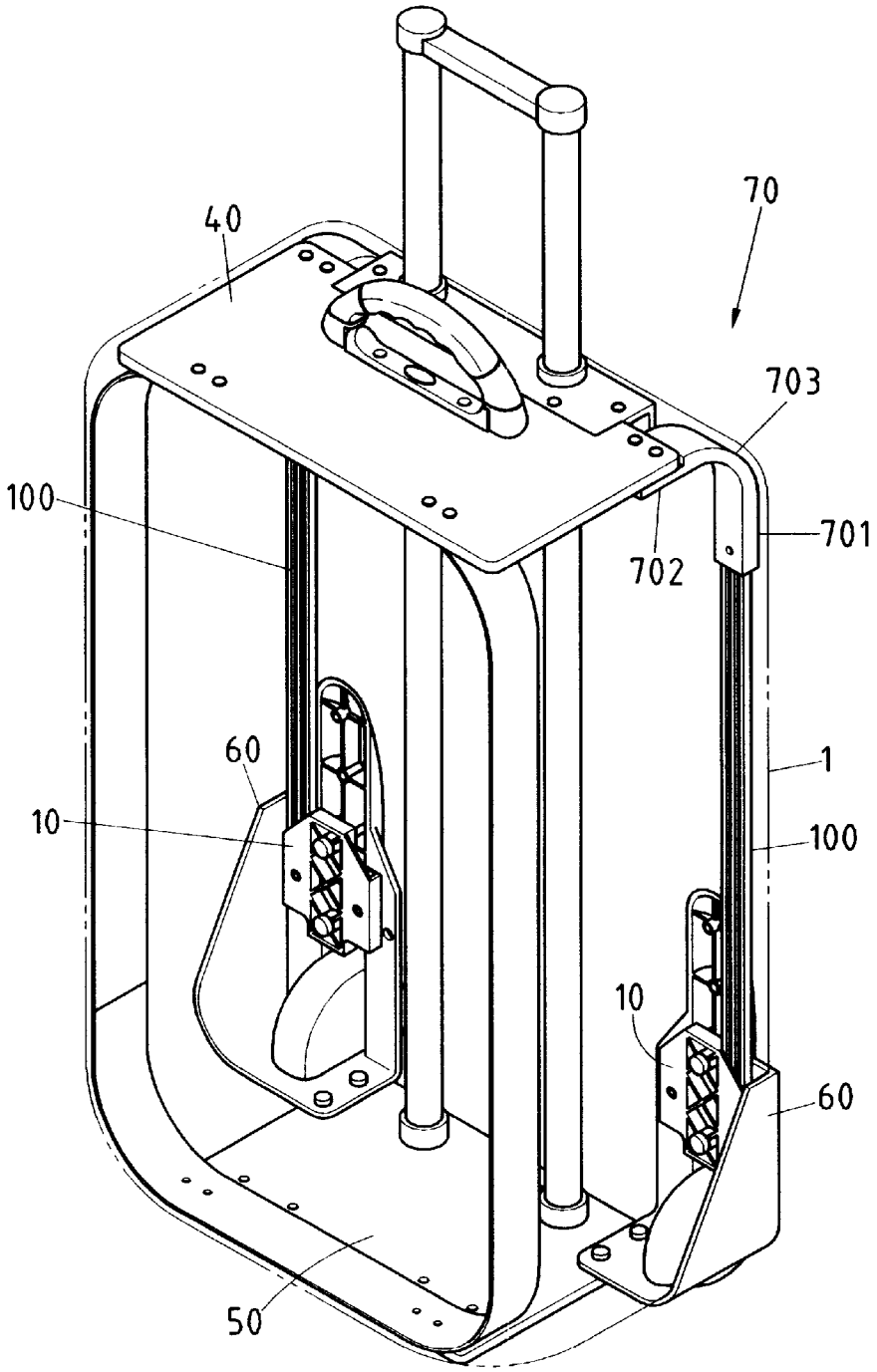
FIG. 2 shows a perspective view of a luggage frame of the first preferred embodiment of the present invention.
Figure 3:
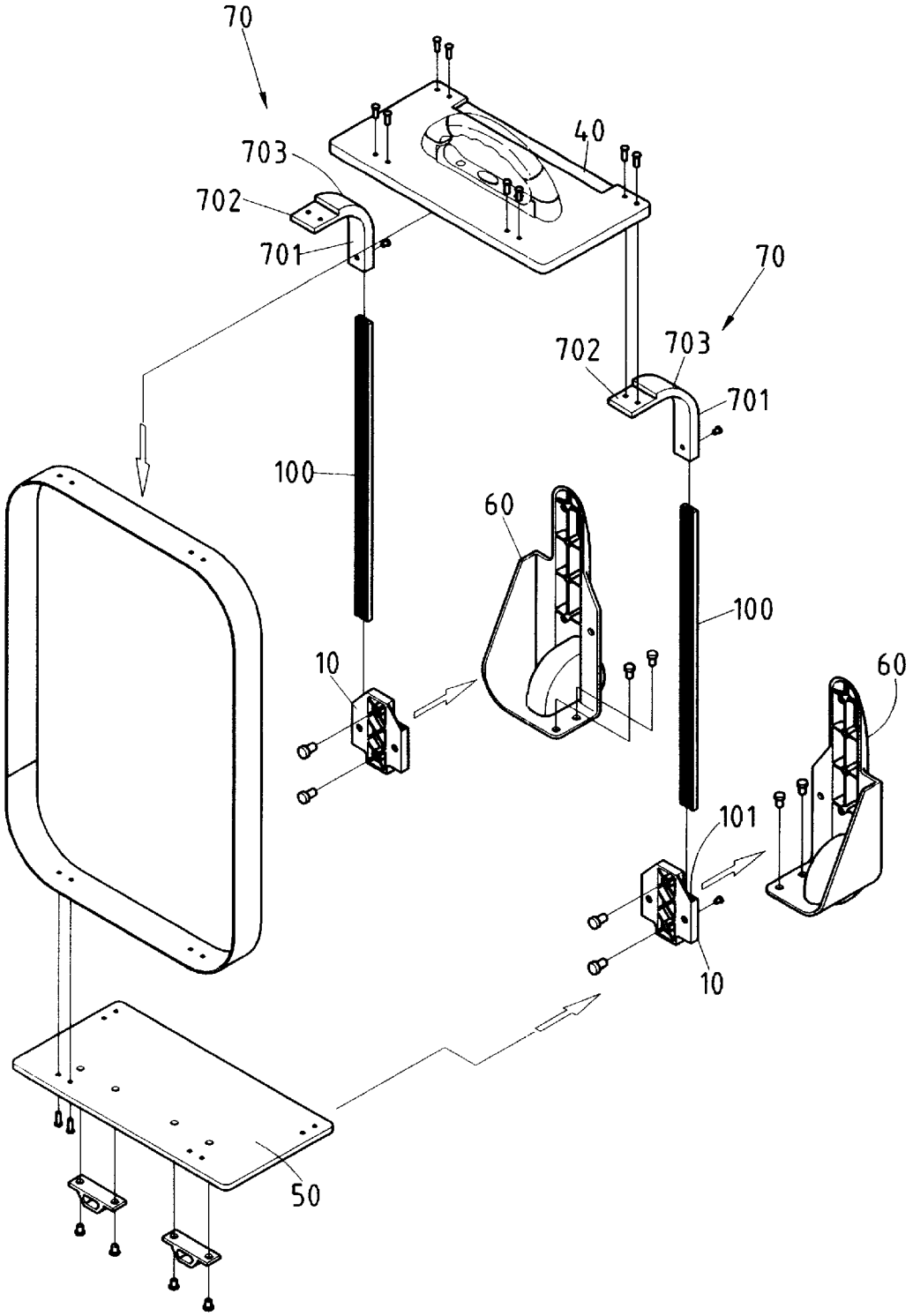
FIG. 3 shows an exploded view of the luggage frame as shown in FIG. 2.
Figure 4:
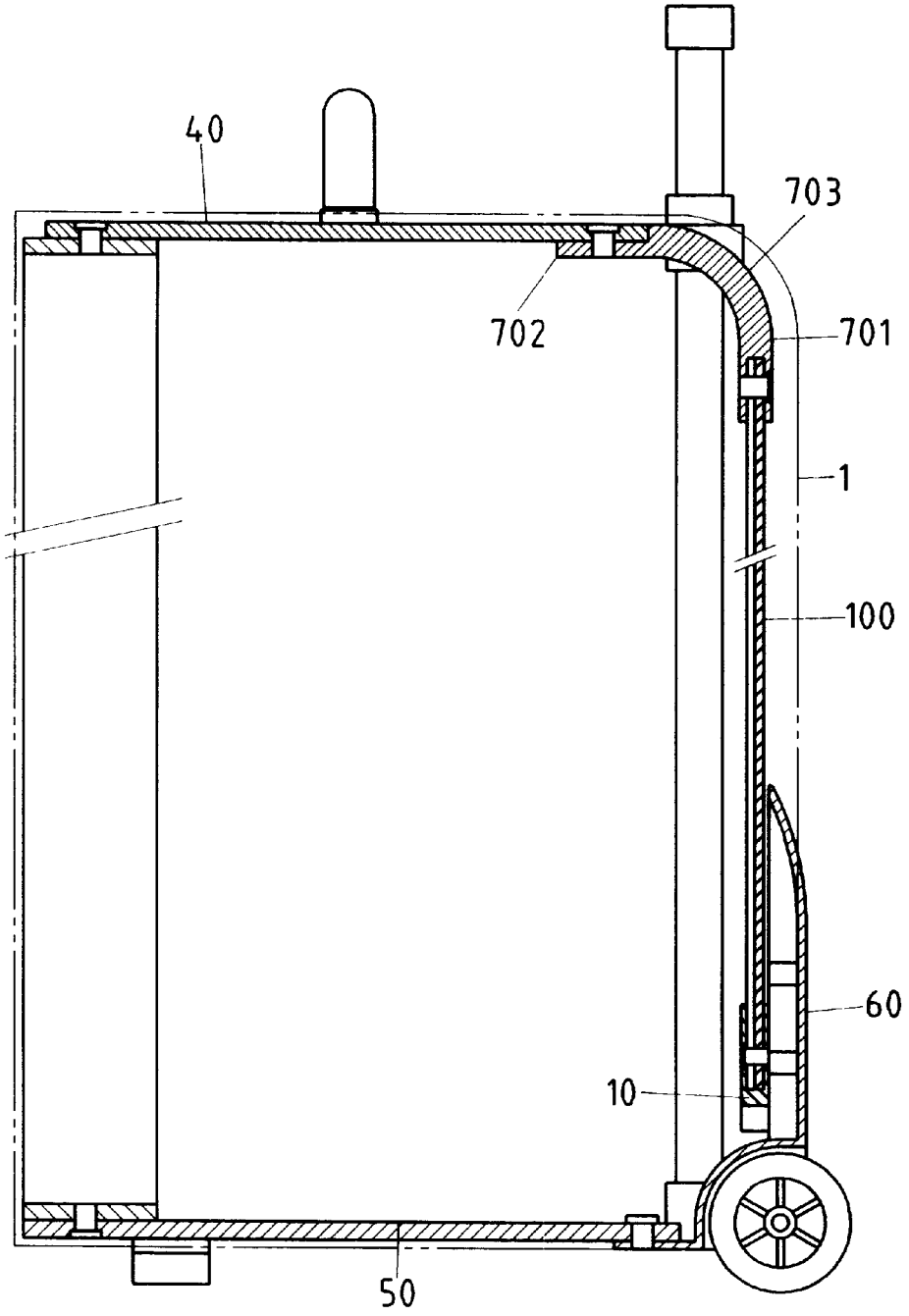
FIG. 4 shows a side sectional view of the luggage frame of the first preferred embodiment of the present invention.
Figure 5:
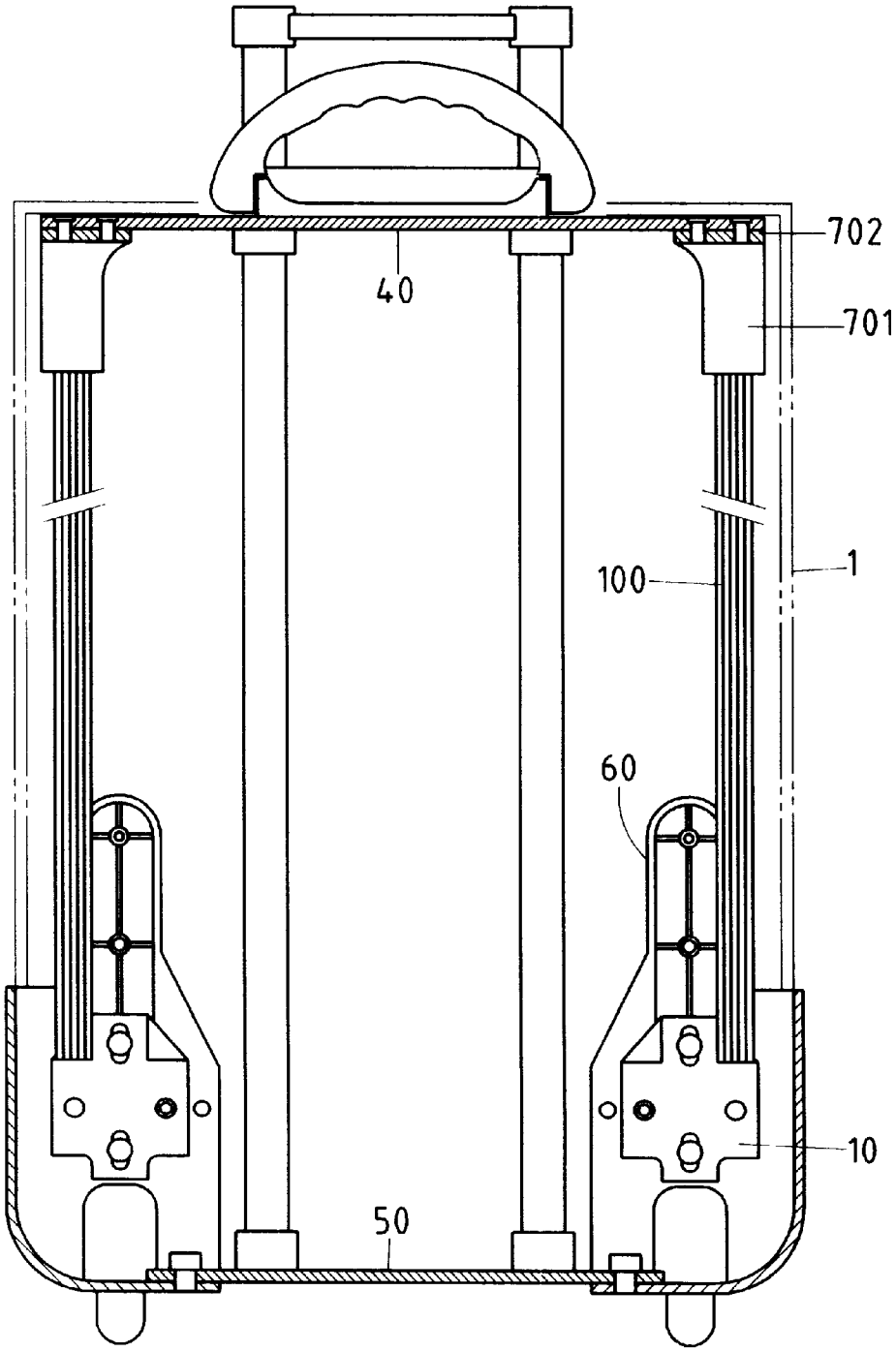
FIG. 5 shows a front sectional view of the luggage frame of the first preferred embodiment of the present invention.

As shown in FIGS. 1–5, a luggage frame 1 of the first preferred embodiment of the present invention comprises two upright support rods 100, two brackets 70 fastened respectively to the top end of the upright support rods 100, two base seats 10 fastened respectively to the bottom end of the upright support rods 100, two caster mounts 60 fastened respectively to the base seats 10, a top plate 40 held by the two brackets 70, and a bottom plate 50 fastened to the caster mounts 60.

The brackets 70 are provided with a vertical arm 701, a horizontal arm 702, and a head portion 703 located between the vertical arm 701 and the horizontal arm 702. The vertical arm 701 is provided in the free end thereof with a receiving slot 705 in which the top end of the upright support rod 100 is securely received in conjunction with a rivet which is received in a rivet hole 706 of the vertical arm 701. The horizontal arm 702 is provided with a plurality of rivet holes 707 for fastening the top plate 40 to the horizontal arm 702 by a plurality of rivets which are received in the rivet holes 707.

The base seats 10 are provided with two receiving slots 101 in which the bottom end of the upright support rods 100 is securely received in conjunction with a rivet. The base seats 10 are fastened to the caster mounts 60 by a plurality of rivets. The bottom plate 50 is fastened to the caster mounts 60 by a plurality of rivets.

Figure 6:
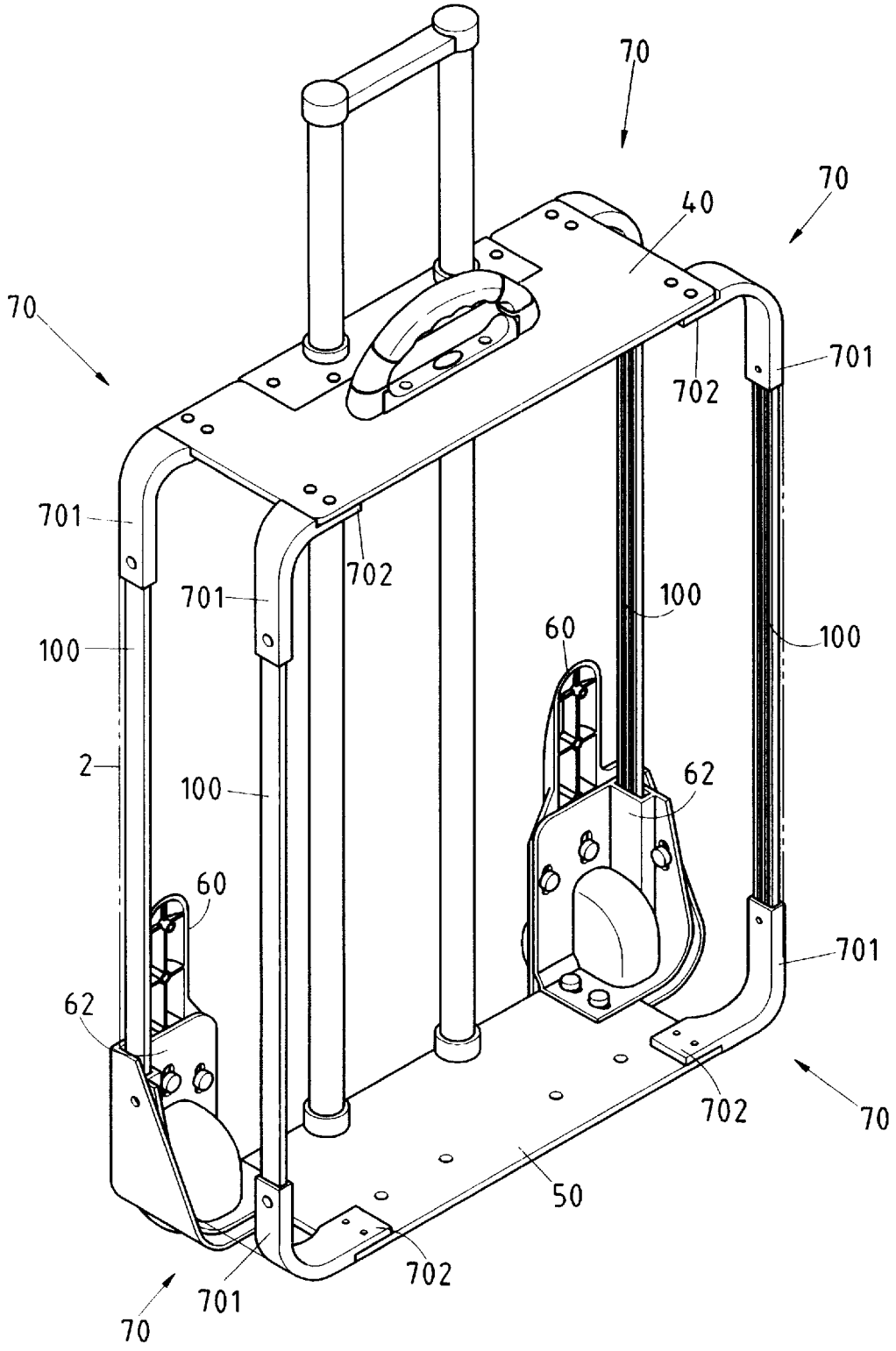
FIG. 6 shows a perspective view of a luggage frame of a second preferred embodiment of the present invention.
Figure 7:
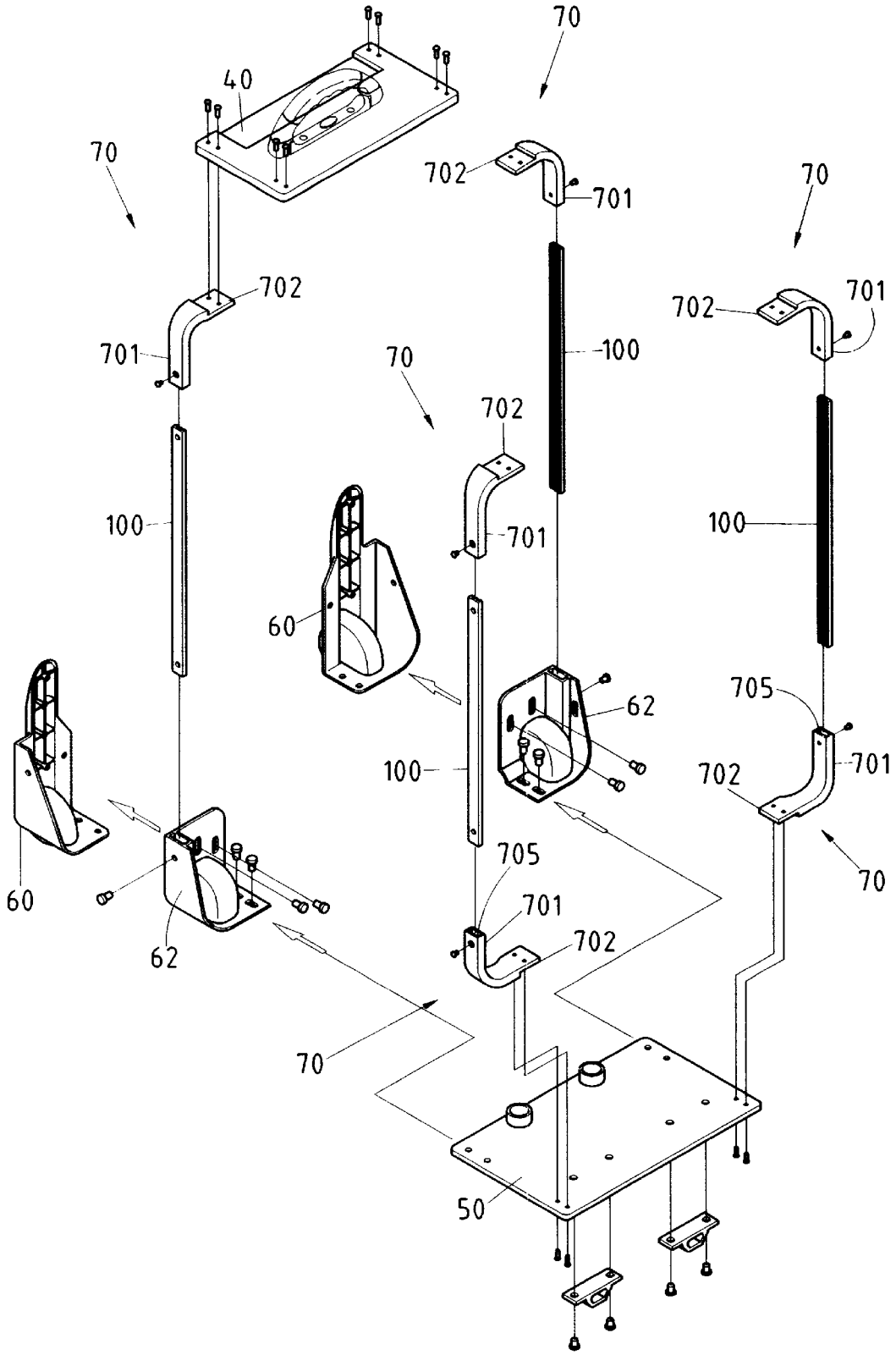
FIG. 7 shows an exploded view of the luggage frame of the second preferred embodiment of the present invention.
Figure 8:
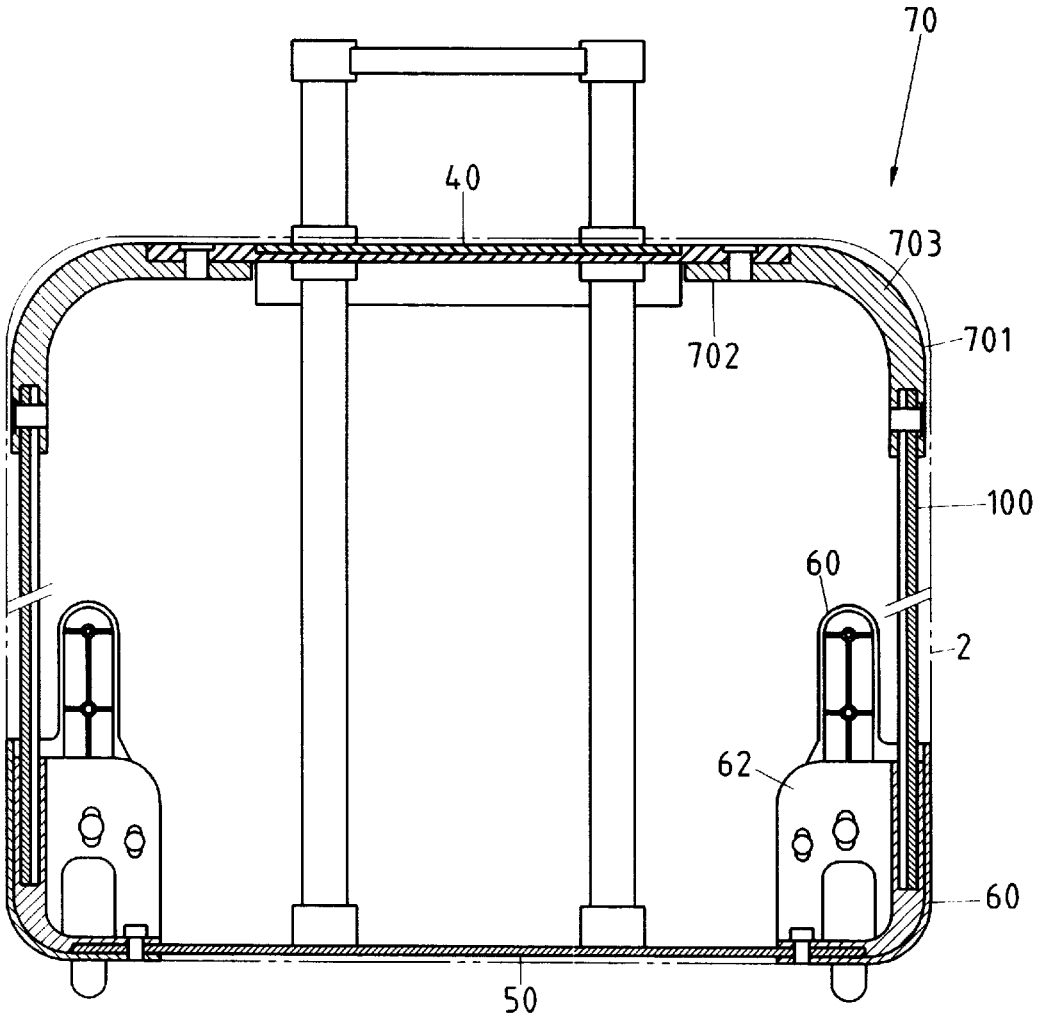
FIG. 8 shows a front sectional view of the luggage frame of the second preferred embodiment of the present invention.
Figure 9:
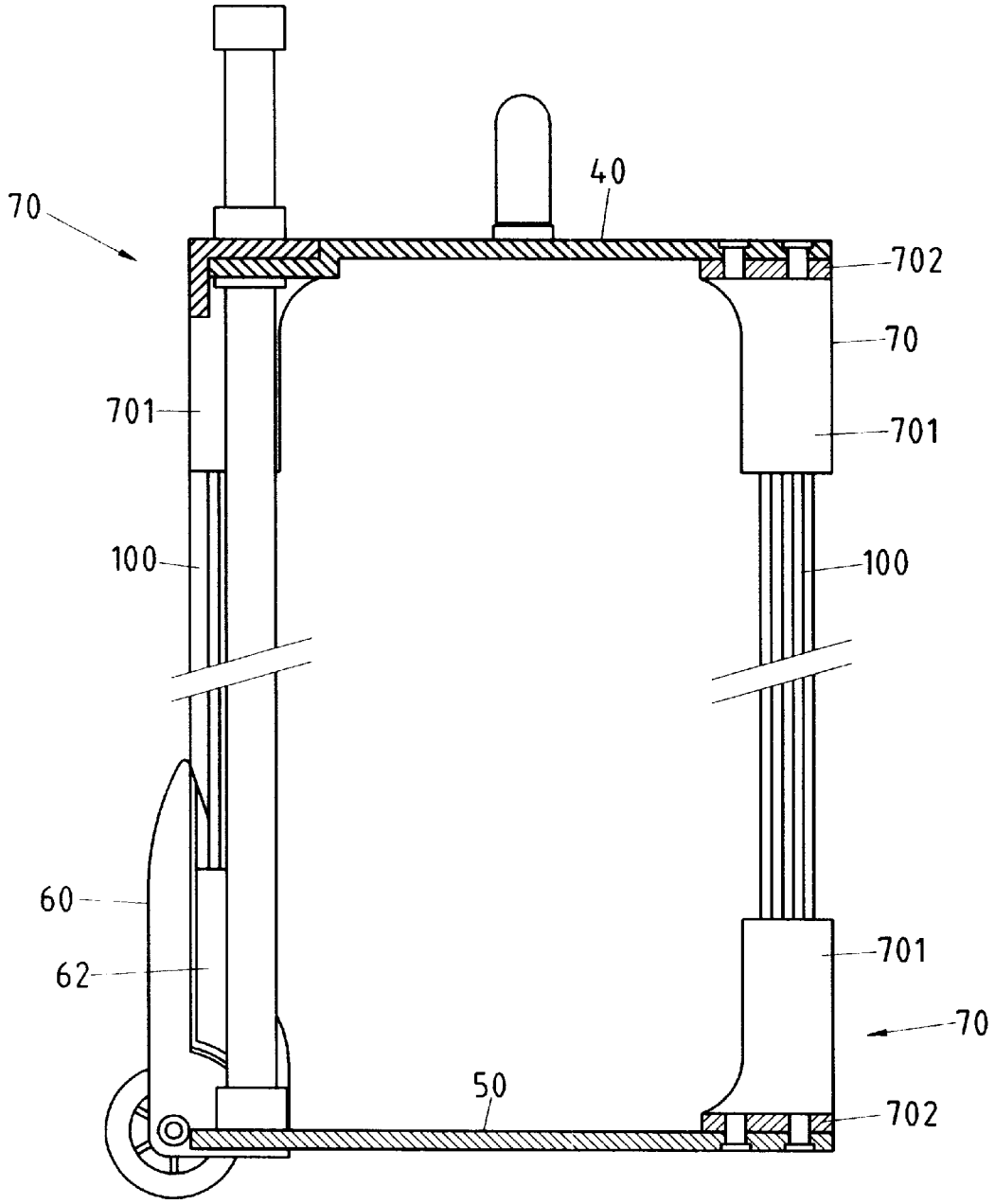
FIG. 9 shows a side sectional view of the luggage frame of the second preferred embodiment of the present invention in combination.

As shown in FIGS. 6–9, a luggage frame 2 of the second preferred embodiment of the present invention is basically similar in construction to the luggage frame 1 of the first preferred embodiment of the present invention, except that the former comprises four upright support rods 100, and two caster covers 62 in place of the two base seats 10 of the first preferred embodiment. The two caster covers 62 are provided with a receiving slot in which the bottom end of the upright support rods 100 is held.

The luggage frames 1 and 2 of the present invention are simple in construction and are therefore relatively light in weight. In light of the upright support rods 100 of the luggage frames 1 and 2 of the present invention being made of a reinforced carbon fiber material, the luggage frames of the present invention are strong and durable.

The embodiments of the present invention described above are to be regarded in all respects as being merely illustrative and not restrictive. Accordingly, the present invention may be embodied in other specific forms without deviating from spirit thereof. The present invention is therefore to be limited only by the scope of the following appended claim.

I claim:

1. A luggage frame comprising:

a first upright support rod;

a second upright support rod;

a first base seat having a receiving slot in which a bottom end of said first upright support rod is received and affixed thereto by a rivet;

a second base seat having a receiving slot in which a bottom end of said second upright support rod is received and affixed thereto by another rivet;

a first bracket having a vertical arm and a horizontal arm, said vertical arm having a receiving slot formed therein in which a top end of said first upright support rod is received;

a second bracket having a vertical arm and a horizontal arm, said vertical arm of said second bracket having a receiving slot formed therein in which a top end of said second upright support rod is received;

a top plate fastened to said horizontal arm of said first bracket and to said horizontal arm of said second bracket;

a fist caster mount fastened directly to said first base seat;

a second caster mount fastened directly to said second base seat; and a bottom plate fastened to said first and second caster mounts.

* * * * *